United States Patent [19]

Matsuo et al.

[11] Patent Number: 4,959,866

[45] Date of Patent: Sep. 25, 1990

[54] SPEECH SYNTHESIZER USING SHIFT REGISTER SEQUENCE GENERATOR

[75] Inventors: Noriko Matsuo; Yukio Mitome, both of Tokyo, Japan

[73] Assignee: NEC Corporation, Tokyo, Japan

[21] Appl. No.: 291,827

[22] Filed: Dec. 29, 1988

[30] Foreign Application Priority Data

Dec. 29, 1987 [JP] Japan ..... 62-333373

[51] Int. Cl.[5] ..... G10L 9/18; G10L 3/00

[52] U.S. Cl. ..... 381/51

[58] Field of Search ..... 381/36, 51–53; 364/513.5

[56] References Cited

U.S. PATENT DOCUMENTS

| | | | |
|---|---|---|---|
| 4,075,424 | 2/1978 | Underwood et al. | 381/51 |
| 4,296,279 | 10/1981 | Stork | 381/51 |
| 4,344,148 | 8/1982 | Brantingham et al. | 381/51 |
| 4,360,708 | 11/1982 | Taguchi et al. | 381/36 |
| 4,389,539 | 6/1983 | Watanabe et al. | 381/51 |
| 4,669,121 | 5/1987 | Shigehara et al. | 381/51 |

*Primary Examiner*—Gary V. Harkcom
*Assistant Examiner*—David D. Knepper
*Attorney, Agent, or Firm*—Sughrue, Mion, Zinn, Macpeak & Seas

[57] ABSTRACT

In order to simplify a speech synthesizer arrangement concurrently with improvement of operation flexibility thereof, a digital memory is arranged to store at least one voiced sound source and at least one unvoiced sound source. One of the sound sources is selected in accordance with the content of a first register, while the data within the selected source is specified by the content of a shift register sequence generator. Each of the bit patterns obtained at the shift register sequence generator is compared with the content of a second register. In the event that the contents of the sequence generator and the second register coincide, the shift register sequence generator is reset and/or the operating conditions(s) of the synthesizer is changed.

5 Claims, 4 Drawing Sheets

SPEECH SYNTHESIZER USING SHIFT REGISTER SEQUENCE GENERATOR

BACKGROUND OF THE INVENTION

1. Field of the Invention

This invention relates generally to a speech synthesizer and more specifically to such a synthesizer which features a simple arrangement and hence is highly suited for being used in large scale integration (LSI).

2. Description of the Prior Art

Various discrete-time models for speech production have been proposed, one of which is disclosed in a book entitled "Digital Processing of Speech Signals", pages 98–106, written by Lawrence R. Rabiner and Ronald W. Schafer, and published by Prentice-Hall, Inc., Englewood Cliffs, N.J. According to the general discrete-time model for speech production disclosed in the above-mentioned book, by switching between voiced and unvoiced excitation generators it is possible to model the changing modes of excitation. However, this known discrete-time model does not suggest any concrete circuit arrangement for achieving the same. Further, this prior art requires the provision of two separate generators, viz., an impulse train generator and a random noise generator both coupled to a voiced/unvoiced switch. Consequently, the prior art has encountered the problem that it is unsuitable for manufacture utilizing LSI techniques.

SUMMARY OF THE INVENTION

It is an object of this invention to provide a speech synthesizer which is simple in configuration and hence is highly suited for manufacture using LSI techniques.

Another object of this invention is to provide a speech synthesizer whose applications are very flexible.

More specifically, the present invention takes the form of a speech synthesizer comprising: a memory, said memory storing at least one voiced sound source and at least one unvoiced sound source; a first register, the first register being arranged so that the content thereof forms a first portion of an address signal applied to the memory; a shift register sequence generator, the shift register sequence generator being arranged so that the content thereof forms a second portion of the address signal; a second register, the register length of the second register being equal to the register length of the shift register sequence generator; a comparator, the comparator being operatively connected with the shift register sequence generator and the second register, the comparator being arranged to output a coincidence signal in the event that the contents of the shift register sequence generator and the second register coincide; and a controller, the controller being operatively connected with the shift register sequence generator, the first register and the second register, the controller being responsive to the coincidence signal to reset at least the shift register sequence generator.

BRIEF DESCRIPTION OF THE DRAWINGS

The features and advantages of the present invention will become more clearly appreciated from the following description taken in conjunction with the accompanying drawings in which like elements are denoted by like reference numerals and in which.

DETAILED DESCRIPTION OF THE PREFERRED EMBODIMENTS

Figure 5:
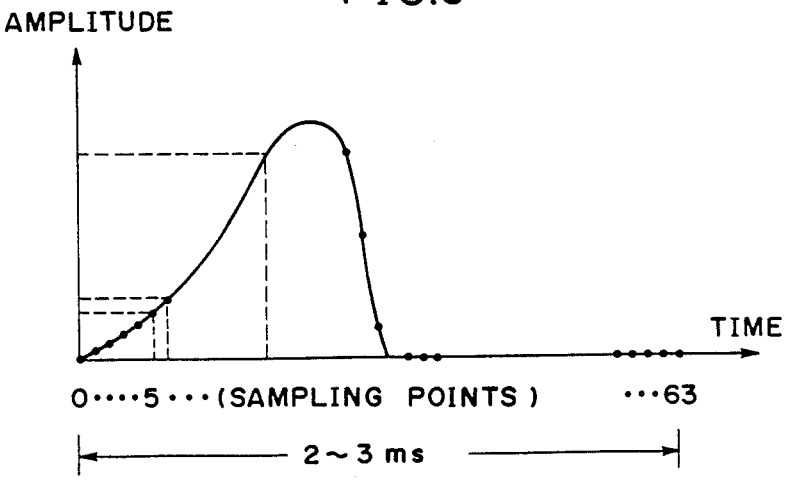
FIG. 5 is an analog waveform of a voiced sound source which is stored in a memory of the FIG. 1 arrangement after being digitized.

This invention will be described with reference to the accompanying drawings of FIGS. 114 5.

Figure 1:
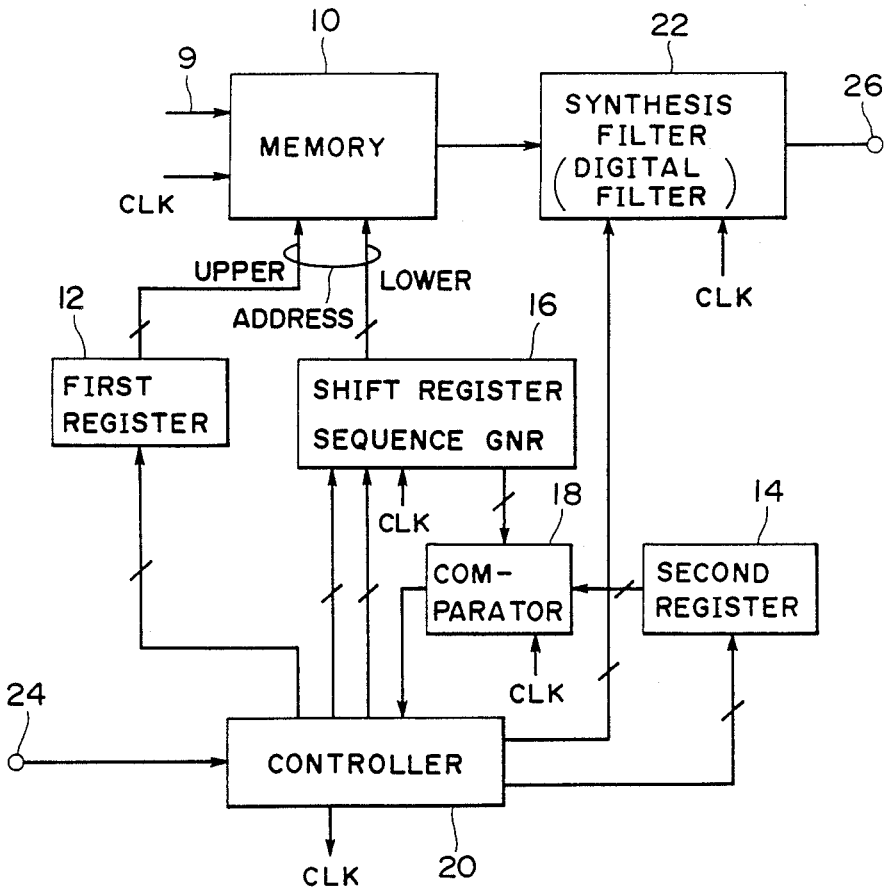
FIG. 1 is a block diagram showing a speech synthesizer according to this invention.

As shown in FIG. 1, the speech synthesizer of this invention comprises a memory 10 which stores at least one voiced sound source and at least one unvoiced sound source, first and second registers 12, 14, a shift register sequence generator 16, a comparator 18, a controller 20 and a synthesis filter (digital filter) 22, all of which are coupled as shown. Reference numeral 24 denotes an input terminal connected to the controller 20, while reference numeral 26 an output terminal from which synthesized speech signals are derived. The synthesis filter 22 itself is well known in the art. A synthesis filter is disclosed in detail in a book entitled "Linear Prediction of Speech" written by J. D. Markel and A. H. Gray, Jr. and published by Springer-Verlag Berlin Heideberg 1976. The synthesis filter 22 is not directly concerned with this invention and hence further description thereof will be omitted for clarity.

The content of the first register 12 forms an address signal in combination with part of the output of the sequence generator 16. More specifically, the content of the first register 12 corresponds to an upper bit(s) of the address signal for selecting one of the voiced and unvoiced sound sources, while part of the content of the sequence generator 16 forms the lower bits of the address signal for specifying data within the source selected by the upper bit(s). A line 9 is used to data access to the memory 10 in the case that it takes a form of random-access memory.

Figure 2:
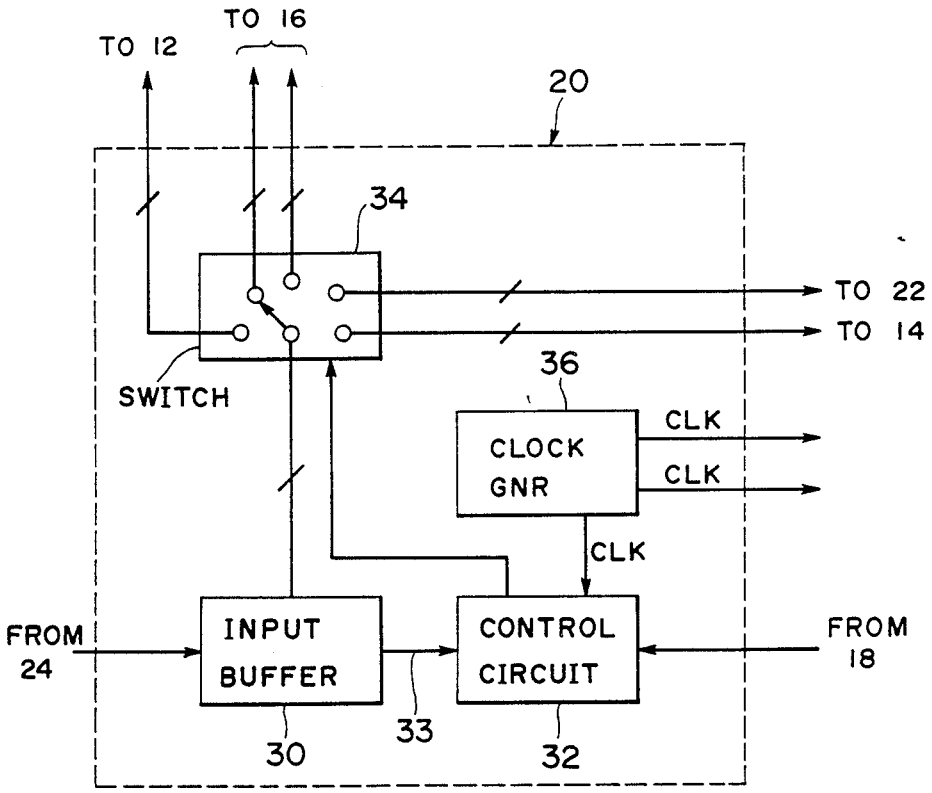
FIG. 2 is a block diagram showing in detail one block of the FIG. 1 arrangement.

FIG. 2 is a block diagram showing in detail the controller 20 shown in FIG. 1. As shown, the controller 20 includes an input buffer 30, a control circuit 32, a switch 34 and a clock generator 36. The input buffer 30 temporarily stores control data applied through the input terminal 24. The comparator 18 (FIG. 1) outputs a coincidence signal in the event that the contents of the sequence generator 16 and the second register 14 coincide. The control circuit 32, in response to the coincidence signal applied thereto, controls the switch 34 in accordance with a control signal applied from the buffer 30 via a line 33. More specifically, the control circuit 32 is responsive to the coincidence signal and selectively allows the data stored in the buffer 30 to be applied to the corresponding block(s) in accordance with the control signal. The operation of the controller 20 will again be described later.

Figure 3:
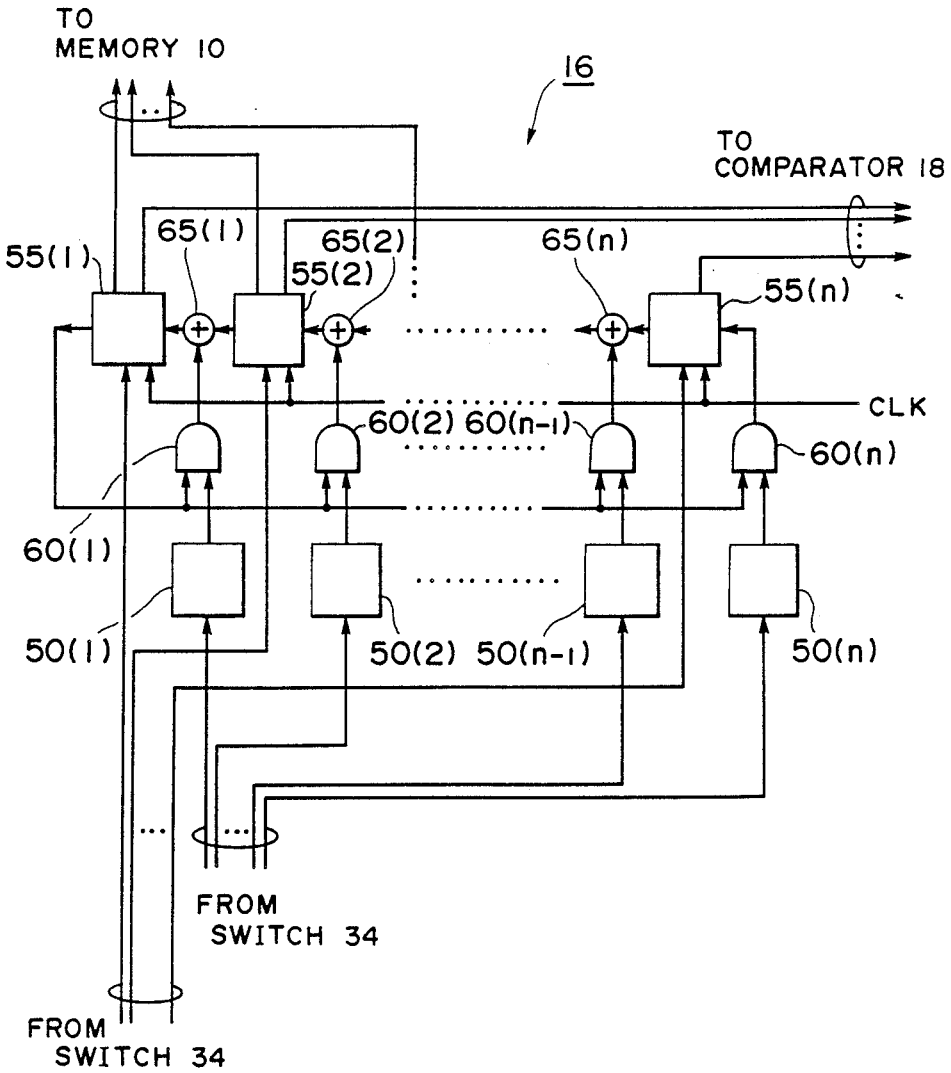
FIG. 3 is a block diagram showing in detail another block of the FIG. 1 arrangement.

FIG. 3 is a block diagram showing in detail the shift register sequence generator 16 of FIG. 1. As illustrated, the sequence generator 16 includes a plurality of coefficient registers 50(1), 50(2), . . . , 50(n−1), 50n, a plurality of data registers 55(1), 55(2), . . . , 55(n), a plurality of AND gates 60(1), 60(2), . . . , 60(n−1), 60(n), a plurality of Exclusive OR gates 65(1), 65(2), . . . , 65(n−1). Each of the coefficient registers (50(1), . . . , 50(n)) has its input coupled to the switch 34 (FIG. 2) and has its output coupled to the corresponding AND gate (60(1), . . . , 60(n)). In the progression of the shift register contents, every possible n-bit combination occurs with the sole exception of the all-zero bit pattern (or word), so that $(2^n-1)$ different bit-patterns are sequentially produced in a periodic manner. The sequence generator 16 shown in FIG. 3 is also called a maximum length linear shift register generator and is used to produce "pseudo-random" sequences. The sequence generator 16 is well known in the art.

Figure 4:
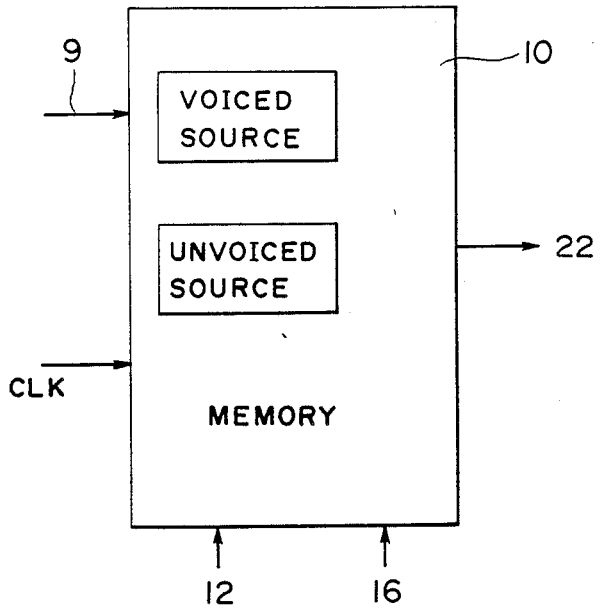
FIG. 4 is a schematic illustration of memory format of a memory which is used in the FIG. 1 arrangement.

FIG. 4 is a memory format of the memory 10 in which only one voiced source and only one unvoiced source are shown in this particular embodiment. The digital data of the voiced sound source in the memory 10 are obtained from an analog waveform of a voiced source (FIG. 5) by digitizing same. As shown in FIG. 5, the analog waveform is sampled at 64 time-points merely by way of example.

The operation of the instant invention will be discussed hereinlater. It is assumed for the purposes of simplicity that (a) the memory 10 holds one voiced sound source and one unvoiced sound source and hence the first register 12 is sufficient to store only 1-bit for selecting either of the two sources, (b) the number of the data registers (55(1), . . . , 55(n)) is 31, (c) the number of sample points of the voiced analog waveform is 64 as above mentioned and therefore (d) the sequence generator 16 applies 6 bits of the whole 31 bits thereof to the memory 10 as the lower bits. The sequences of bit patterns of the generator 16 should previously be simulated in terms of different initial data applied to the data registers (55(1) . . . 55(n)) and also different coefficients applied to the registers (50(1) . . . 50(n)). Thereafter, the second register 14 is supplied with one bit pattern whose position in the sequence is known with a predetermined initial condition of the generator 16. It should be noted that each of the blocks 12, 14, 16 and 22 is able to receive the data from the input buffer 30 via the switch 34.

In the event that the contents of the sequence generator 16 and the second register 14 coincide, the comparator 18 produces a coincide signal. The control circuit 32, in response to the coincide signal, applies a control signal to the switch 34 considering the control signal applied from the input buffer 30. For example, in the case where the control circuit 32 resets the generator 16 without changing the contents of the registers 12 and 14, then the same sequence of data is derived from the memory 10 to the synthesis filter 22. It is understood that by changing the data applied to the blocks 12, 14 and 16, different sequences of data with different periods can be applied to the synthesis filter 22.

In the above, only one voiced sound source and only one unvoiced sound source are stored in the memory 10. However, more than two voiced sound sources and more than two unvoiced sound source can be provided, in which case the number of bits outputted from the register 12 should be increased to meet the number of source to be selected. Further, if the rate of clocks applied to the data registers (55(1) . . . 55(n)) be faster than that applied to the other blocks, operation speed of the device can be increased.

The foregoing description shows only preferred embodiments of the present invention. The various modifications possible without departing from the scope of the present invention which is only limited by the appended claims will be apparent to those skill in the art.

What is claimed is:

1. A speech synthesizer comprising:

a memory, said memory storing at least one voiced sound source and at least one unvoiced sound source;

a first register, said first register being coupled to said memory and arranged so that the content of said first register forms a first portion of an address signal applied to said memory;

a shift register sequence generator, said shift register sequence generator being coupled to said memory and arranged so that the content of said shift register sequence generator forms a second portion of said address signal;

a second register, the register length of said second register being equal to the register length of said shift register sequence generator;

a comparator, said comparator being connected to said shift register sequence generator and said second register in such a way that the contents of said shift register sequence generator and said second register are caused to flow into said comparator, said comparator being arranged to output a coincidence signal in the event that the contents of said shift register sequence generator and said second register coincide; and a controller, said controlling being connected to said shift register sequence generator, said first register, said second register and said comparator, said controller being responsive to said coincidence signal to reset at least said shift register sequence generator, said controller providing inputs to said shift register sequence generator, said first register, and said second register.

2. A speech synthesizer as claimed in claim 1, wherein said first portion of said address signal determines one of the voiced and unvoiced sound sources and wherein said second portion of said address signal specifies data to be retrieved from the sound source which is defined by said first portion.

3. A speech synthesizer as claimed in claim 1, wherein said memory is a read-only memory detachable from said speech synthesizer.

4. A speech synthesizer as claimed in claim 1, wherein said memory is a random-access memory into which said at least one voiced sound source and said at least one unvoiced sound source are written from the exterior of said speech synthesizer.

5. A speech synthesizer as claimed in claim 1, wherein said controller controls the contents of said first and second registers in response to said coincidence signal.

* * * * *

UNITED STATES PATENT AND TRADEMARK OFFICE

CERTIFICATE OF CORRECTION

PATENT NO. : 4,959,866

DATED : September 25, 1990

INVENTOR(S) : Noriko MATSUO and Yukio MITOME

It is certified that error appears in the above-identified patent and that said Letters Patent is hereby corrected as shown below:

Col. 2, line 15, delete "114 5" and insert -- 1-5 --.

Signed and Sealed this

Thirty-first Day of March, 1992

*Attest:*

HARRY F. MANBECK, JR.

*Attesting Officer*

*Commissioner of Patents and Trademarks*